US006568683B1

(12) United States Patent
Harpaz

(10) Patent No.: US 6,568,683 B1
(45) Date of Patent: May 27, 2003

(54) GAMES GRID BOARD-LIFE GAMES

(76) Inventor: Yehouda Harpaz, 129 Corrie Road, Cambridge CB1 3QQ (GB)

( * ) Notice: Subject to any disclaimer, the term of this patent is extended or adjusted under 35 U.S.C. 154(b) by 0 days.

(21) Appl. No.: 09/913,388

(22) PCT Filed: Feb. 14, 2000

(86) PCT No.: PCT/GB00/00460

§ 371 (c)(1),
(2), (4) Date: Aug. 14, 2001

(87) PCT Pub. No.: WO00/57973

PCT Pub. Date: Oct. 5, 2000

(30) Foreign Application Priority Data

Mar. 29, 1999 (GB) ..... 9907163
Aug. 19, 1999 (GB) ..... 9919551

(51) Int. Cl.[7] ..... A63F 3/02; A63F 3/00
(52) U.S. Cl. ..... 273/460; 273/237
(58) Field of Search ..... 273/460, 454, 273/455, 153 R, 237; 463/9

(56) References Cited

U.S. PATENT DOCUMENTS 4,216,965 A * 8/1980 Morrison et al. ..... 273/237
4,359,220 A * 11/1982 Morrison et al. ..... 273/273
4,513,973 A * 4/1985 Sinclair ..... 273/237
5,286,037 A * 2/1994 Ghaly ..... 273/460
5,743,796 A * 4/1998 Orak et al. ..... 463/9
6,231,441 B1 * 5/2001 Golad ..... 463/9

* cited by examiner

*Primary Examiner*—Marguerite McMahon

(57) ABSTRACT

A board is made of many grid points (1 and 2) arranged in a grid on a flat surface (6), and connect to a game manager (3) (a CPU+memory+software). Each grid point notifies the games manager when it is pressed, and the games manager can illuminate each grid point by one of two color. Every fixed period of time (generation) the games manager checks for each point the illumination state of the point and of a pattern of points around it, and accordingly decides what will be the illumination state of the point in the next generation. The player(s) can also affect the illumination state of a point by pressing it, and the task of the player(s) is to keep some points illuminated as long as possible, cause all the points to be switched off as fast as possible, or cause all illuminated points to be only in one color.

4 Claims, 4 Drawing Sheets

GAMES GRID BOARD-LIFE GAMES

This invention relates to board games in which a move is done by indicating a point on the board, and the state of the game is expressed in the state of the points. These include traditional games like Go, but also large number of other potential games, puzzles and exercises. The invention presents an electronic board to play these games, and a new family of games to play on it.

Games like Go are played by each player, in his turn, adding a pebble to the board, on one of the points in a grid of lines drawn on the board, or in one of the squares on the board. These games have the advantages of being based on simple playing acts and being interesting intellectually. Their disadvantages are:

1) They require somewhat tricky movement when putting the stone on the board in the right place without disturbing other stones.
2) They tend to suffer from delays when a player is thinking on a move.
3) Some of the moves require additional 'housekeeping' operations, e.g. taking stones of the board in Go.
4) The players need to keep the rules and do the counting of stones themselves, which puts extra demand on the players.
5) The stones are separate objects, which are easily lost.
6) It is not possible to play games where the arrangement of occupied points is changed periodically.

Disadvantages 3–6 can be solved by programming a computer to display the board and stones. The program would be simple enough that it can be put on a small and cheap CPU, and hence be built into a standalone playing board. In principle, the computer could also limit the time allocated to each player, thus solving disadvantage 2.

The problem of input (disadvantage 1), however, is not solved so well by current electronic systems. That is because input for existing electronic systems is normally done through buttons, or other devices, which are separated from the display. For games where there is a small repertoire of possible different inputs this is acceptable, but for board games there are many possible different inputs (the number of points in the grid). Inputting a point on buttons off the display requires the players to perform some mental operation to convert the point they think about to the right input. This is relatively slow and error-prone process. For slow-going games that is very annoying but may be acceptable, but it makes it impossible to play fast on these systems, and for most people this is a decisive factor.

This disadvantage can be overcome by a making an interactive board in which the input and the display are together, and these kinds of boards started to appear, at least as patent applications. However, the range of the games that can be played on these boards is still limited.

For over 30 years, computer scientists and mathematicians were investigating the behaviour of what is called the game of life, which was invented by John Conway. The game of life is not really a game, because there is no task that any player tries to perform. Instead, it is a phenomenon that is being investigated. It is executed by a computer on a square grid of cells, each of which can be in an ON or OFF state. A pattern of cells is set in the ON state and the rest of the cells in the OFF state, and then the pattern evolves in according to some rule, which specifies which cell is in the ON state in each instant according to the state of the cell and the state of its eight neighbouring cells in the previous instance. The resulting patterns are interesting enough to be a subject of investigation.

The current invention describes a simple interactive board and a novel family of games which draw on the basic idea behind game of life which can be played on the board.

The conceptual structure of the hardware of the board is sketched in FIG. 1.

According to the current invention the user accessible part of the board is made of grid points 1 & 2 which are arranged in a grid on a flat surface 6. Each grid point is a clearly visible element 1 which can detect when it is pressed, and can be illuminated in at least two colours by an illumination source 2 in or below the surface. The figure shows only 3 grid points for clarity, but the actual board has many more grid points (typically 36–1000). The figure also shows the illumination source 2 separately from the visible part of the grid point 1, which denotes the fact that pressing a grid point does not affect its illumination. All the grid points are connected to a games manager 3, which is a CPU+memory+software. When a grid point is pressed, the games manager 3 is notified (arrows from the visible part 1 to the games manager 3), and the games manager 3 controls which sources of illumination are on (arrows from the games manager 3 to the sources of illumination 2). The games manager is programmed to manage various games. Managing a game means that the board displays the state of the game by putting on the appropriate sources of illumination 2. When a sensor 1 is pressed, the games manager computes the implication according the rules of the current game, and chances some of the sources of illumination 2 (possibly none) to reflect the new state of the game. The board may also change which sources of illumination are on when no point is pressed. This board can be used to implement many games. Some of these games are variations of a family of games which will be called here the Life games. The basic rules of a life game are: every fixed period of time (generation) the games manager checks for each point the illumination state of the point and of a pattern of points around it, and accordingly decides what will be the illumination state of the point in the next generation. The player(s) can also affect the illumination state of a point by pressing it, and the task of the player(s) is to keep some points illuminated as long as possible, cause all the points to be unilluminated as fast as possible, or cause all illuminated points to be only in one colour.

To allow the users to utilise all the functionality of the board, it will need a control area 4, which allows the players to change the current game, change the rules of the current game and change other parameters, like the length of time that each player has to perform his move. The control area 4 also displays the current score of the game. Typically, the control area will contain few control buttons and an alphanumeric display. The games manager receives information from the control area about which control buttons were pressed, and controls what is displayed in the alphanumeric display.

The basic functionality of the games manager comprises these actions:

1) When the users indicate through the control area 4 that they want to change the current game or any of the parameters of the current game, the game manager sets its own internal state to the new value, and indicates to the users the new value.
2) When one of the grid points is pressed and the current game and parameters make it illegal for the current player to press some of the points, the games manager checks if the pressed point is allowed according to the rules and parameters of the current game and the current state of the game (i.e. which points are illuminated). If the pressed point is not allowed, the games board may issue some indication that an illegal point was pressed, may indicate why it is not allowed by some message through the control area 4, and may indicate which points are allowed (e.g. by flashing them). Note that illuminated points, while typically are not allowed, may be allowed in some games.

3) When a point is pressed and it is allowed according to the current rules, parameters and state of the game, the games manager computes the implications and then changes the illumination of some (possibly zero) points to reflect the new state of the game. Note that:
   a) While typically the point that is pressed changes its illumination, this is not mandatory.
   b) Other points except the pressed point may change as well.
4) If the rules of the current game require it, the games manager changes the illumination of some points even when none of the points is pressed, typically once each some time period (or 'generation').
5) After each change to the illumination of any grid point, the games manager computes the current score and displays it using the control area 4.
6) After each change to the illumination of any grid point, the games manager checks, using a game-specific routine, if the game is finished. If the game is finished, the games manager indicates it, typically by some message in the control area 4, and maybe other additional signals.

The board will also need a way to signal whose turn it is, which would typically be done by two turn lights 5, which are in two separate colours, corresponding to two of the colours of the illumination in the grid points. The games manager controls these turn lights, and signal to the players whose turn it is by switching the corresponding turn light.

The arrangement of the grid points would be in most cases square as in FIGS. 3 and 4, but can also be of different shapes (e.g. hexagonal (as shown in FIG. 5), triangular or less regular). The overall shape of the board would typically be square, but can also vary, e.g. a jagged-edge rectangle as in FIG. 5.

The kind of games that the board will be programmed to play include (but not restricted to):

1) Traditional two-person games like Go, where each player is associated with one colour.
2) Novel two-person games.
3) Puzzles and single-player games.
4) Fluid games, which means games where the patterns of illuminated points changes even when the player(s) don't press any point, like Life games which are described here.
5) Memory games.

LIFE GAMES

Because of the basic rule of changing illumination in each generation, the illumination pattern of the board tends to change each generation, though there are some exceptional patterns that do not change. The novelty in this invention is the combination of this idea with the grid board and interaction with the user, to produce a family of games.

In general, the actual rule to determines which point is illuminated can be any of large possible rules, and there is no obvious way to decide what is a good rule to use. The main requirements of the rule are:

1) It causes interesting changes in the pattern of illumination.
2) It is not too 'strong', in the sense that the players need to be able to affect the illumination pattern in a desired way by pressing few points.

Additional possible requirement is that it is simple enough that the players can analyse the game, but this is not necessary, as players can use their intuition or simply guesses to play and still enjoy the game. The rules that are used in the example, which are based on counting how many of the closest 8 points are illuminated, are simple and give interesting games. The rule that is used in Life1 is probably the most commonly used rule in the investigation of game of life, while the rule in Life2 is novel. It is expected that different rules will be developed in the future. In particular, boards with different arrangements of points will probably require different rules for interesting games.

The task of the player(s) can be one of:

1) Switch off all the points as fast as possible.
2) keep at least some points illuminated as long as possible.
3) When the game is between two players, one player tries to get points illuminated in one colour to dominate the board.

It is possible to add other kinds of tasks. For example, see the 'groups' counting in Life1 (p. 7).

A specific embodiment of the invention will now be described with reference to the accompanying drawings.

Figure 4:
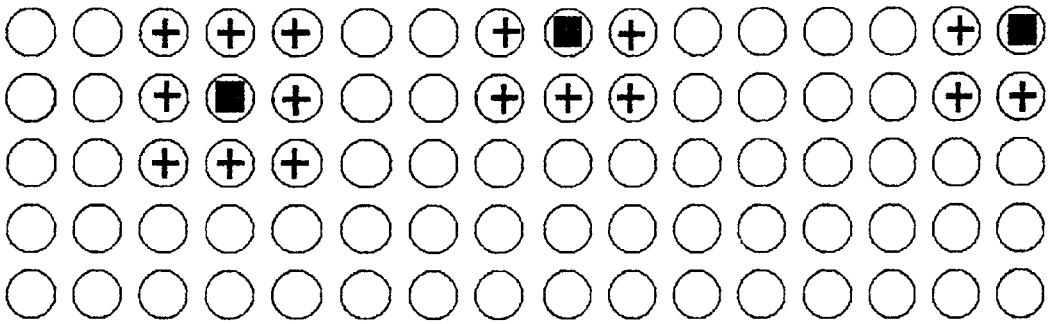

FIG. 4 demonstrates the meaning of neighbours in the example games.

Figure 5:
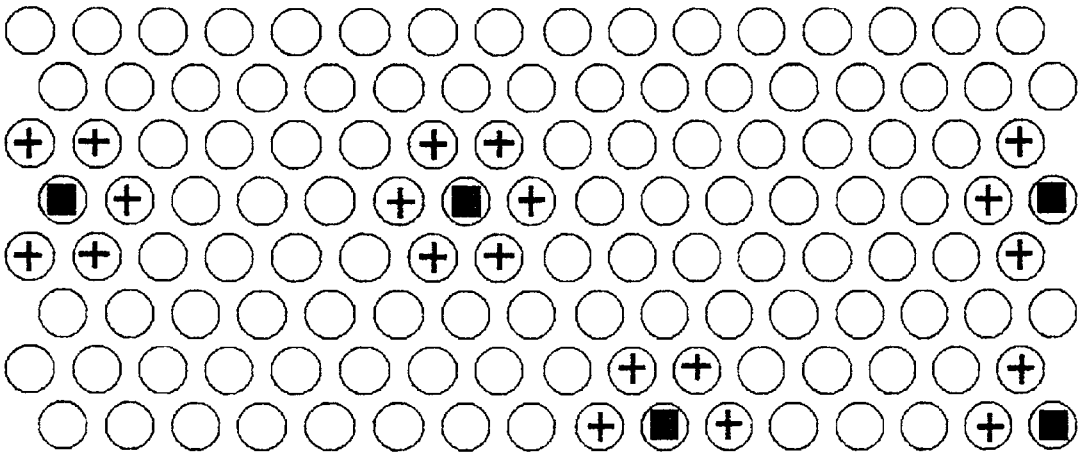

FIG. 5 demonstrates a potential alternative layout of the board, and the meaning of neighbours in this layout.

The inputs of grid points 1 are implemented by a custom-design membrane keyboard 7 on a PCB 6, which together comprise the top of a flat rectangular box. The membrane keyboard contains a grid of 9×9 translucent buttons 1, which are in a shape of small domes. Between the buttons the membrane is painted with lines 8 drawn on the imaginary lines connecting the centres of the buttons. The PCB 6 has holes below each button, with additional holes 9 for the turn lights. Both the PCB 6 and the membrane keyboard 7 has a hole for the alphanumeric display 11.

The illumination of the grid points is implemented by 9×9 pairs of LEDs 2 mounted on a PCB 12, which is itself mounted below the membrane keyboard such that each LEDs pair 2 is under the centre of one of the buttons 1. In each pair one LED is of one colour (e.g. green) and the other of another colour (e.g. red). Alternatively, each LEDs pair can be replaced by a bi-colour LED. The two turn lights 5 are implemented by two large LEDs, one in one of the colours of the pairs of LEDs 2, and one in the other colour, mounted on PCB 12 as the rest of the LEDs. The electronic circuitry to drive the LEDs 2 and the turn lights 5 is also on PCB 12.

Figure 1:
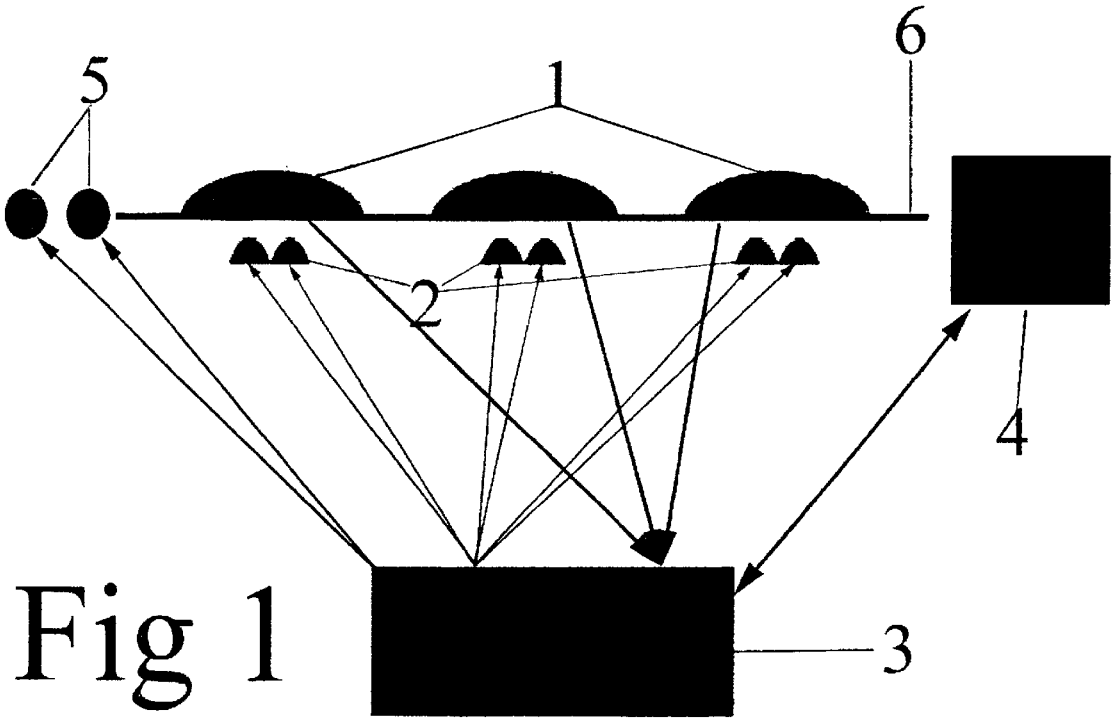
FIG. 1 shows the conceptual structure of the board.
Figure 2:
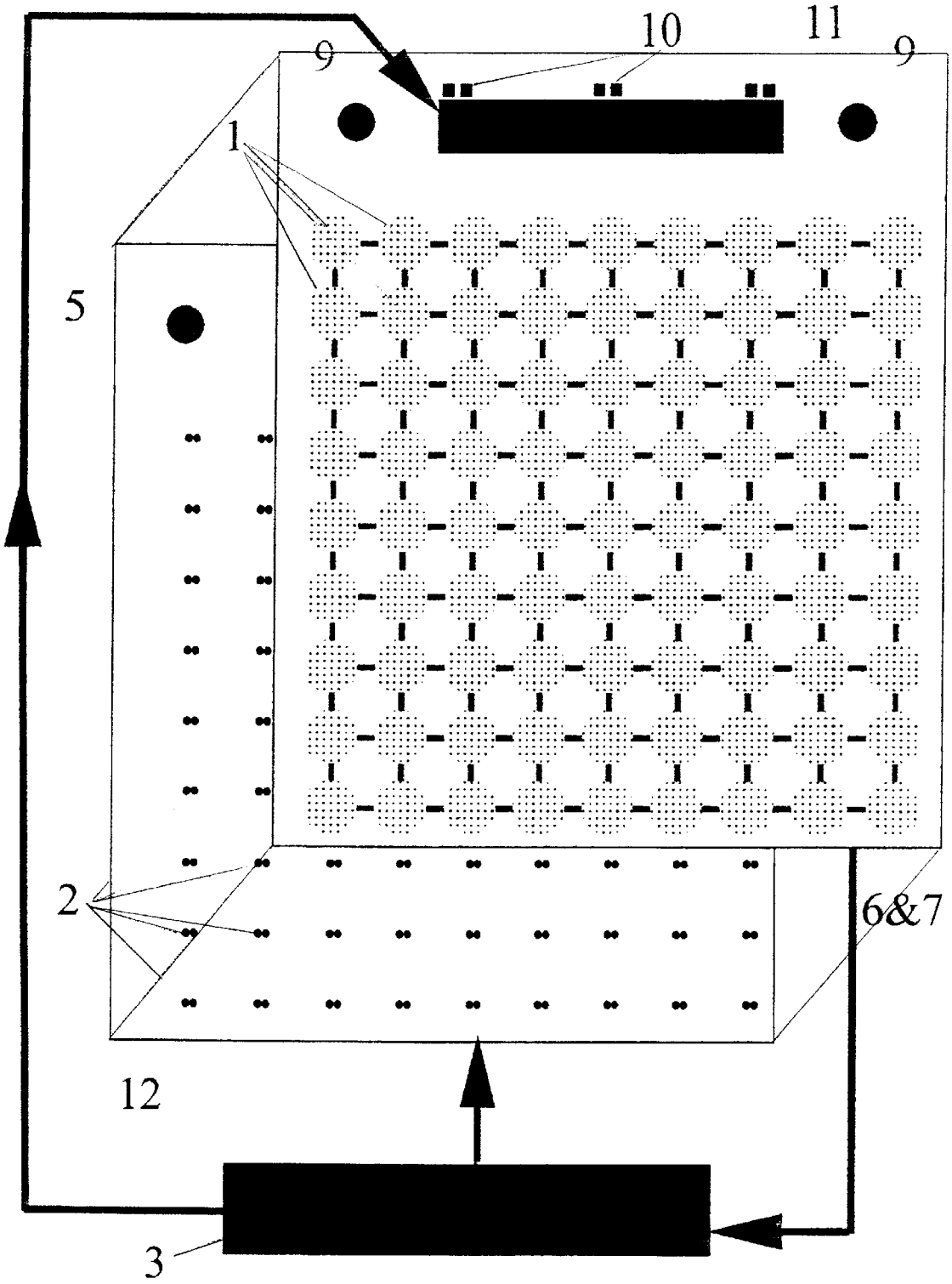
FIG. 2 shows a sketch of the electronic components of an example board.

The membrane keyboard 7 also contains several control buttons 10, which allow the users to control the game (start, stop etc.) and to select which game is played and set parameters for the current game. An alphanumeric display 11 is mounted in a hole in the membrane keyboard 7. The control buttons 10 and the display 11 together comprise the control area 4 of FIG. 1.

All the input from the membrane keyboard goes to the games manager 3, which is a small CPU (around 5 MIPS) and a little ROM and RAM (around 64 Kb and 4 Kb respectively). The games manager 3 is placed below the LEDs PCB 12. A custom design electronic circuitry (denoted by arrows from the membrane keyboard 7 to the games manager 3, and from the games manager 3 to the PCB 12 and to the display 11) allows the games manager 3 to switch on and off each individual LEDs, and to display the appropriate information in the alphanumeric display.

Figure 3:
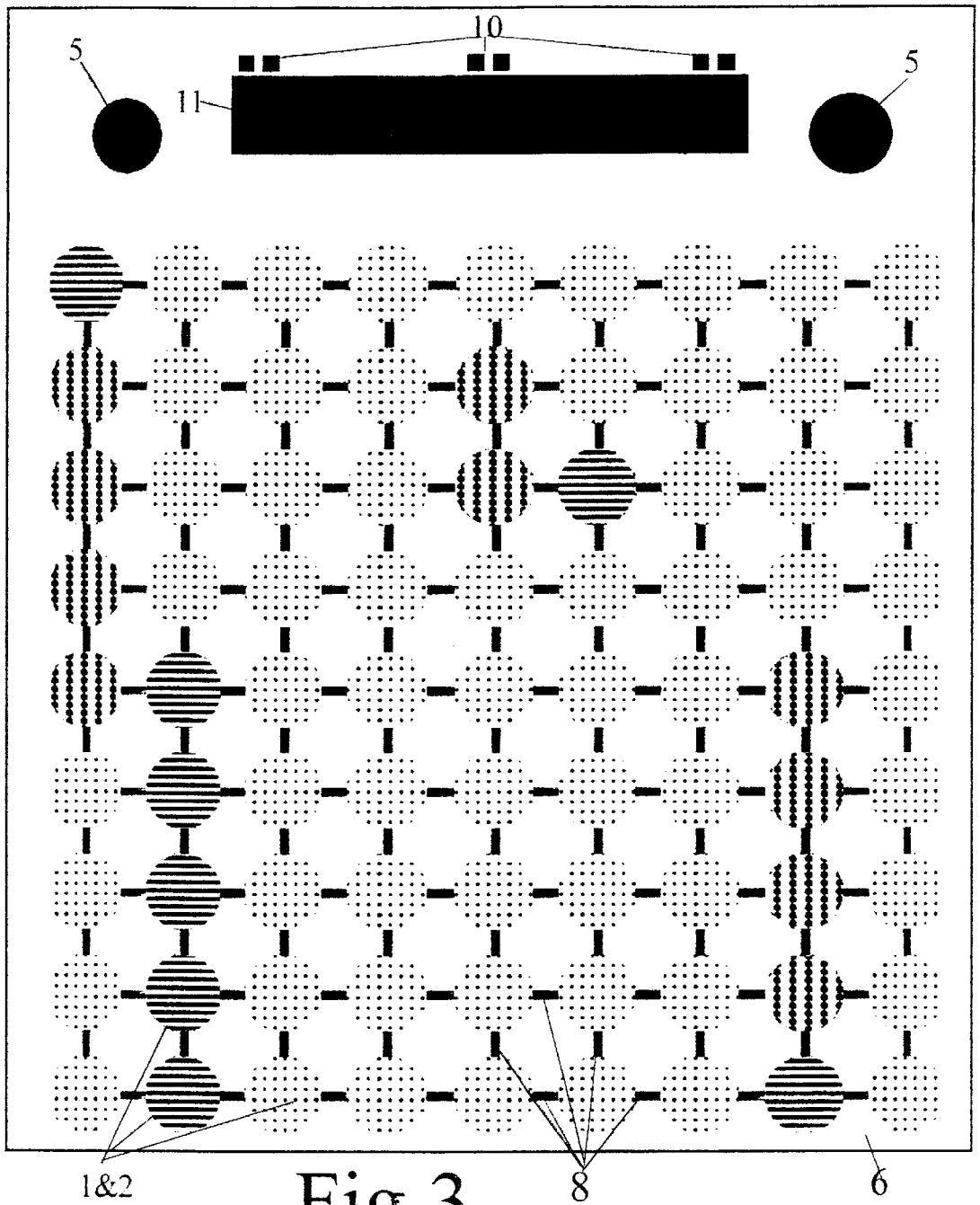
FIG. 3 is a sketch of the way the board looks for players from above.

FIG. 3 shows a sketch of the board from above in a middle of a game, with some grid points illuminated. Most of the grid points are not illuminated (circles with points). Some of the points are illuminated in one of two colours (indicated in the figure by two different shading). Because the buttons are translucent (rather than transparent), the LEDs 2 are not actually visible.

The embodiment of the grid points which is described above seems to be the most effective with current technology, but some parts can easily be changed if and when other technologies improve or new technologies become available, without affecting the overall design of the board. The detection of pressing a grid point may be done by any discrete input device, for example standard contact switch and capacitive switch. The illumination of the grid points can be done by other kind of sources, for example gas-discharge lamps and incandescent lamps.

The Software

The central loop of the software repeats these four steps:

1) Check if any of the control buttons was pressed. If any control button was pressed, perform the appropriate operation (change the game, set a parameter, stop the game, start the game).
2) Check if any of the grid points was pressed. If so, compute the implications according to the rules of the current game, perform all the changes to the board, and, if the current game is a two player game, switch the turn to the other player. Switching the turn means switching the turn light of the current player off, setting the internal variable current player to the other player, switching the turn light of the other player on and setting a variable, the turn end mark, to the current time plus the turn time.
3) Check the clock and compare it to various time marks. A time mark is a variable set to some value, which is compared to the current time. The most important is the turn end mark, and if this is passed, switch the turn as in 2. Other time marks are for updates of the displays.
4) Check if there are game specific operations to perform. If a player plays one of the two-players games against the board, this check perform the board's move. In the implementation of the Life games described below, this also includes checking if the time that has passed from the previous update of the board is more than the generation time, and if it is perform another update according to the rule of the current game.

The Life Games on the example board

The example board has two Life games: Life1, which is played by one player at a time, and Life2, which is a two players game.

In both games, the pattern of the illumination changes each fixed period of time (generation), according to the illuminated state of the point itself and of its neighbours. For most of the points the neighbours are the closest eight points around the point, but for a point on the side of the board it is the closest five points, and for a point in the corner it is the closest three points. This is demonstrated by FIG. 4, in which the circles represent points, and each group of a full square and surrounding pluses represent a point and its neighbours respectively. As described above, the layout of the board can vary, and with it the exact meaning of neighbours. FIG. 5, with the same notation as FIG. 4, demonstrates the meaning of neighbours of a point on a board with hexagonal arrangement of points and a jagged-edge rectangle shape.

When a player presses a point, if this point was illuminated, it become unilluminated. If the point was unilluminated, it is switched on with the player's colour.

The length of each generation is a settable parameter which the player(s) can set to fit their own speed and mood.

Life1

The game Life1 can be played in two modes (a settable parameter): one-player mode or two-players mode. In both modes, each game starts with a number of points (a settable parameter) illuminated in random positions, or in a fixed configuration if the parameter is set to 0. Then the illumination pattern evolves according to this rule: in each generation, the board checks how many of the neighbours of each point are illuminated. If the point is illuminated and the number of illuminated neighbours is two or three, the point stays illuminated, otherwise it is switched off. If the point is unilluminated, and the number of illuminated neighbours is three, it is switched on, otherwise it stays unilluminated.

Experience showed that this rule on its own is too 'strong', i.e. makes it too difficult for the players to affect the evolution of the pattern. Therefore, additional rule is that a point that has been illuminated for some fixed number of generations (a settable parameter) is forcibly switched off, independently of the number of illuminated neighbours. In addition, if the number of illuminated points is below some number (a settable parameter), they are all switched off.

When the playing mode is one-player, the board displays the number of generations from the beginning of the game and the number of illuminated points. In addition, it awards the player points when the pattern of illumination contain separate groups of illuminated points, and displays the total points awarded in the current game. Groups of illuminated points are defined in this way: two illuminated points are in the same group if either 1) they share a common neighbour (possibly unilluminated), or
2) there is an illuminated point which is in the same group with both of them, either by the previous rule or by the present rule.

In the one-player mode, points that have been illuminated for more than a number of generations (a settable parameter) are illuminated in a different colour, so the player can see which points are going to be switched off forcibly in the following generations.

The player in the one-player mode decides for himself what the task he tries to achieve: switching off all points as fast as possible, keeping some points illuminated as long as possible, or accumulating as many points for separate groups as possible. By setting the various parameters, any player can fit the game to his own speed and coordination.

The preferred playing mode is two-players, in which the players compete in sets, which are made of an indeterminate number of games. The colour in which the points are illuminated switches in each game, and the player that is associated with the current colour plays the game. When all the points are unilluminated, the game ends and a new game starts with the points illuminated in the other colour, and the other player playing. The board accumulates the number of generations that all the games played by each player took, and display both numbers. The players try to keep this number as small as possible, by switching off the points as fast as possible in each game. The players decide when the competition ends, typically when one of the numbers reaches some fixed number, and the winner is the player with the smaller number. The players can also play with the intention of increasing their number as much as possible, but that is less interesting game.

Life2

In life2, the game starts with points illuminated in both colours. Then the illumination pattern evolves according to these rules: In each generation, the board checks for each point if it is illuminated, and how many of its neighbours are illuminated in each colour. If a point is unilluminated, the board compares the number illuminated neighbours in each colour, and if the difference is 2, the point is switched on with the colour of the majority of the illuminated neighbours. If the point is illuminated, the board multiply the number of neighbours which are illuminated by the other colour by 2, and then subtract the result from the number of neighbours which are illuminated in the point's colour. If the result is 2 or 3, the point stays illuminated, otherwise it is switched off.

As described above, a player can either switch one of the illuminated points off, whatever its colour, or switch on an unilluminated point with his own colour. The board signals whose turn it is by switching on one of the turn lights, and passes the turn to the other player when the player plays or when the turn time runs out. When all the illuminated points are of the same colour, the player of this colour wins.

Experience shows that the game is more interesting when the number of plays that each player can perform is restricted to a small number (a settable parameter in the range 1–10). With this rule, players have to judge carefully when to make their move such that it will have the best effect.

What is claimed is:

1. An electronic board comprising a grid of grid points on a flat surface, where each grid point is a visible element which is capable of detecting when it is pressed, and can be illuminated in two different colours by an illumination source inside or below the surface; and a game manager made of a CPU and memory, connected electronically to the grid points and illumination sources such that it has complete control on which grid point is illuminated and in what colour, and it is notified whenever any of the grid points is pressed, and a computer program which is executed by the CPU, which manages two or more games, some of which have these basic rules: every fixed period of time the games manager checks for each point the illumination state of the point and of a pattern of points around it, and accordingly decides what will be the illumination state of the point in the next fixed period of time; the player(s) can also affect the illumination state of a point by pressing it; and the task of the player(s) is to keep some points illuminated as long as possible, or cause all the points to be unilluminated as fast as possible, or cause all illuminated points to be only in one colour.

2. A board as described in claim 1, where at least one of the games is a one player game, and the task of player is to switch off all the points as fast as possible.

3. A board as described in claim 1, where at least one of the games is a two players game, each player is associated with one of the colours, and the task of each player is to cause all illuminated points to be illuminated with his/her colour.

4. A board as in claim 1, where the arrangement of the points is hexagonal.

* * * * *